US007744014B2

(12) United States Patent
Dick et al.

(10) Patent No.: US 7,744,014 B2
(45) Date of Patent: Jun. 29, 2010

(54) INJECTION MODULE

(75) Inventors: Jürgen Dick, Laaber (DE); Heinz Lixl, Regensburg (DE); Willibald Schürz, Pielenhofen (DE); Martin Simmet, Bad Abbach (DE)

(73) Assignee: Continental Automotive GmbH, Hannover (DE)

( * ) Notice: Subject to any disclaimer, the term of this patent is extended or adjusted under 35 U.S.C. 154(b) by 235 days.

(21) Appl. No.: 11/041,587

(22) Filed: Jan. 24, 2005

(65) Prior Publication Data

US 2005/0145726 A1 Jul. 7, 2005

Related U.S. Application Data

(63) Continuation of application No. PCT/DE03/02327, filed on Jul. 10, 2003.

(30) Foreign Application Priority Data

Jul. 25, 2002 (DE) ..... 102 33 906

(51) Int. Cl.
*F02M 47/02* (2006.01)
*B05B 15/00* (2006.01)

(52) U.S. Cl. ..... 239/88; 239/397.5; 239/533.2; 239/584

(58) Field of Classification Search ..... 239/88, 239/89, 91, 533.1, 533.2, 585.1, 585.3, 585.4, 239/585.5, 102.2, 397.5; 310/346, 328, 341
See application file for complete search history.

(56) References Cited

U.S. PATENT DOCUMENTS

| | | | | |
|---|---|---|---|---|
| 5,610,436 | A * | 3/1997 | Sponaugle et al. | 257/669 |
| 5,727,662 | A * | 3/1998 | Guy et al. | 188/315 |
| 6,213,414 | B1 * | 4/2001 | Stier et al. | 239/584 |
| 6,333,587 | B1 * | 12/2001 | Heinz et al. | 310/328 |
| 6,422,482 | B1 | 7/2002 | Stier et al. | 239/102.2 |
| 6,454,239 | B1 | 9/2002 | Boecking | 251/129.06 |
| 6,471,142 | B1 * | 10/2002 | Lambert | 239/88 |
| 6,731,048 | B2 | 5/2004 | Kawazoe | 310/328 |
| 2002/0195904 | A1 | 12/2002 | Sumrak et al. | 310/346 |

FOREIGN PATENT DOCUMENTS

| | | | |
|---|---|---|---|
| DE | 29 17 933 | A1 | 11/1979 |
| DE | 198 26 339 | A1 | 12/1999 |
| DE | 199 09 106 | A1 | 9/2000 |
| DE | 199 50 762 | A1 | 4/2001 |
| DE | 100 25 997 | A1 | 12/2001 |
| DE | 101 59 748 | A1 | 6/2003 |
| EP | 0828075 | | 3/1998 |
| EP | 1 256 711 | A1 | 5/2002 |
| JP | 10009084 | | 1/1998 |
| JP | 10089192 | | 4/1998 |
| JP | 2000170628 | | 6/2000 |
| JP | 2002203997 | | 7/2002 |
| WO | 0025019 | | 5/2000 |
| WO | 0060259 | | 10/2000 |
| WO | WO 00/65224 | | 11/2000 |
| WO | 0123745 | | 4/2001 |

* cited by examiner

*Primary Examiner*—David Hwu
(74) *Attorney, Agent, or Firm*—King & Spalding L.L.P.

(57) ABSTRACT

An injection module comprises a housing (1), inside of which an actuator element (2) and an injection valve are arranged. The actuator element (2) is designed for controlling the injection valve by a setting stroke. A compensating element (6) is provided that is connected to the actuator element (2) in order to compensate for the change in length of the housing (1) caused by thermal expansion.

14 Claims, 2 Drawing Sheets

INJECTION MODULE

CROSS REFERENCE TO RELATED APPLICATION

This application is a continuation of copending International Application No. PCT/DE03/02327 filed Jul. 10, 2003 which designates the United States, and claims priority to German application no. 102 33 906.6 filed Jul. 25, 2002.

TECHNICAL FIELD OF THE INVENTION

This invention relates to an injection module.

DESCRIPTION OF THE RELATED ART

According to the embodiment of an injection module, a movable insert is provided which is used for example in order to transfer a deflection of an actuator to an injection needle of an injection valve. If piezoelectric actuators are used, precise adjustment of the movable insert with respect to a final control element is required. This is necessary because on the one hand piezoelectric actuators can only realize a short displacement stroke and on the other hand, because of different thermal coefficients of expansion between the injection valve housing and the piezoelectric actuator, a defined idle stroke must be maintained between the piezoelectric actuator and a final control element to be actuated.

This defined idle stroke must first be overcome during actuation by the actuator element before the status of the injection valve can be changed. This has the disadvantage that higher actuating voltages and/or relatively large piezoelectric actuator elements are required in order to make the necessary actuating path available for controlling the injection valve.

SUMMARY OF THE INVENTION

It is therefore the object of the present invention to provide an injection module in which the size of the defined idle stroke can be reduced.

According to the invention an injection module is provided with a housing in which an actuator element and an injection valve are disposed. The actuator element is designed in such a way as to control the injection valve by means of a change in length. A compensating element is connected to the actuator element in order to compensate the negative effects caused by the change in length of the housing due to thermal expansion.

Said compensating element exhibits an intrinsic thermal expansion which is added to the thermal expansion of the actuator element. In this way the thermal expansion of the compensating element and the actuator element can be precisely set. Matching the common thermal expansion of actuator element and compensating element to the thermal expansion of the housing removes the need to maintain a defined idle stroke between actuator element and the final control element to be actuated. This permits smaller actuator elements to be provided since the necessary actuating stroke of the actuator element can be reduced. Alternatively the actuating voltage of the actuator element for controlling the injection valve can be reduced.

According to one embodiment of the invention the compensating element is supported at a retaining point in such a way that the thermal expansion of the housing between the retaining point and the injection valve is essentially equivalent to the common thermal expansion of actuator element and compensating element. In this case the actuator element is connected to the housing via the compensating element rather than directly to the housing.

According to a further embodiment of the invention it can be provided that a thermally conducting element is disposed on the compensating element in order to effect a temperature compensation between the compensating element and the housing. The function of the thermally conducting element is to counteract a temperature difference between the housing and the compensating element or, as the case may be, actuator element. It permits faster temperature compensation between the various elements. This is necessary because the thermal expansions of the housing and of the compensating element and the actuator element have to be matched to one another when they have the same temperature. More particularly in the starting phase of the engine, the components of the injection module have different temperatures because heat is transferred from the outside to the inside. The provision of the thermally conducting element therefore has the advantage of producing a faster temperature compensation between the exterior, i.e. the housing, and the interior of the injection module, i.e. the compensating element and the actuator element.

Preferably it is provided that the thermally conducting element is in contact with both the housing and the compensating element. This has the advantage that a better transfer of heat is possible via the thermally conducting element as a result of the direct contact.

According to a further embodiment of the invention it is provided that the thermally conducting element is embodied as a sleeve, preferably a metal sleeve, made of a material exhibiting good thermal conductivity, which material comprises in particular copper, brass, silver or a similar element. The sleeve can be disposed around the compensating element and is therefore easy to install during assembly simply by slipping it over a cylindrical compensating element.

It can be provided that the sleeve has longitudinal slits, with the ridges formed by the longitudinal slits being curved. The ridges enable the sleeve to be held in place between the housing and the compensating element, it being immaterial whether the ridges are curved toward the inside or toward the outside. If the ridges are curved toward the inside, they abut the compensating element and press the edges of the sleeve against an internal wall of the housing. If the ridges are curved toward the outside, they abut the internal wall of the housing and the edges of the sleeve are in contact with the compensating element.

BRIEF DESCRIPTION OF THE DRAWINGS

A preferred embodiment of the invention will be explained in more detail below with reference to the attached drawing, in which.

DETAILED DESCRIPTION OF THE PREFERRED EMBODIMENTS

Figure 1:
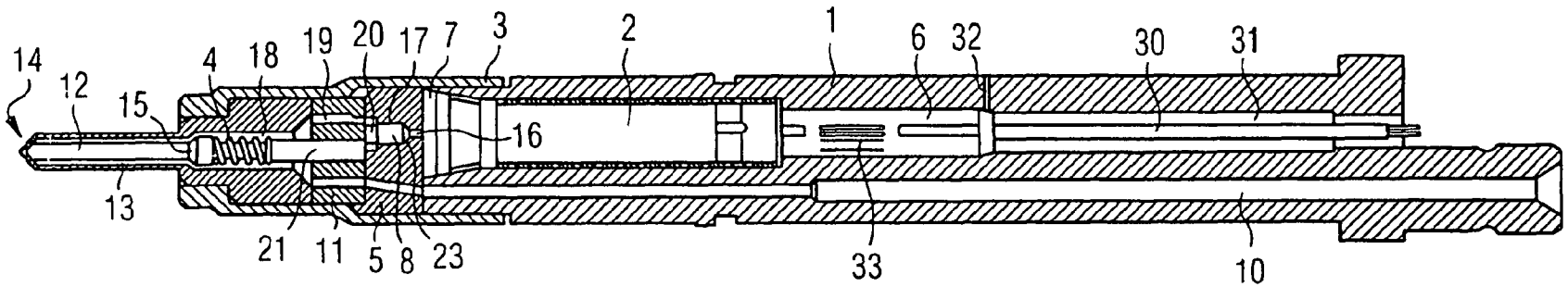
FIG. 1 shows an injection module according to a preferred embodiment of the invention.

FIG. 1 shows a cross-section through an injection module comprising a housing 1 into which an actuator element 2 is introduced. The housing 1 is bolted by means of a clamping nut 3. The clamping nut 3 tightens a nozzle body 4 and a valve plate 5 into the housing 1. In this arrangement an upper end surface of the nozzle body 4 is in contact with a lower end surface of the valve plate 5. An upper end surface of the valve plate 5 is in turn in contact with a lower end surface of the housing 1.

The actuator element 2 is located between a base plate 7 and a compensating element 6. A spring sleeve is disposed around the actuator element 2 in order to pretension the actuator element 2. The base plate 7 is disposed movably with respect to the housing 1. The base plate 7 has a control stud 16 which is associated with a pin part 23 of a closing element 8. The closing element 8 is disposed in a discharging aperture 17 of the valve plate 5. The discharging aperture 17 is embodied essentially cylindrically and tapers into a conical shape in its upper area. The conical area of the discharging aperture 17 constitutes a sealing seat for the closing element 8. The closing element 8 is embodied essentially cylindrically and likewise tapers in its upper area via a conical shape into the pin part 23. The discharging aperture 17 is connected to a feed channel 10 via a feed hole 18 which is incorporated into the guide plate 11, the feed channel 10 being routed in the housing 1 and representing a fuel connection.

Disposed between the feed hole 18 and the discharging aperture 17 is a feed choke 19. The discharging aperture 17 is hydraulically connected to a control chamber 20 which is incorporated in the guide plate 11 and is delimited by a movably mounted actuating piston 21. The actuating piston 21 is actively connected to a valve needle 12 whose tip is associated with an injection aperture 14. Embodied around the injection aperture 14 is a sealing seat for the tip of the valve needle 12. Embodied between the valve needle 14 and the nozzle body 4 is a fuel chamber 13 which is likewise connected to the feed channel 10. In addition corresponding fuel holes are incorporated in the nozzle body 4, in the guide plate 11 and in the valve plate 5.

The actuator element 2 is preferably embodied as a piezoelectric actuator and is controlled via control lines 30 which are routed to the actuator element 2 via a control line channel 31. For this purpose the compensating element 6 is provided with a hole, essentially parallel to its longitudinal axis, through which the control lines 30 are guided.

The injection valve operates as follows: in the non-activated state of the actuator element 2 the control stud 16 does not act on the pin part of the closing element 8. The feed channel 10 is connected to a fuel reservoir which makes fuel available at high pressure. Consequently fuel under high pressure is present in the fuel chamber 13, the control chamber 20 and the discharging aperture 17. Due to the high fuel pressure the closing element 8 is pressed into the associated sealing seat and closes the discharging aperture 17. At the same time the valve needle 12 is pressed downward by the high fuel pressure that is present in the control chamber 20 onto the sealing seat of the injection aperture 14 via the actuating piston 21. As a result the injection aperture 14 is closed and no injection takes place.

If the actuator element 2 is now activated, that is to say energized with electric current, the actuator element 2 expands and in the process presses the base plate 7 downward, thereby forcing the control stud 16 against the pin part 23 of the closing element 8. As a result of this the closing element 8 is lifted off from the associated sealing seat. Consequently the discharging aperture 17 is opened and fuel is discharged from the control chamber 20. This causes the fuel pressure in the control chamber 20 to drop, since less fuel is supplied via the feed choke 19 than flows out via the discharging aperture 17. As the valve needle 12 has a pressure collar 15 in the area of the fuel chamber 13, the high fuel pressure present in the fuel chamber 13 lifts the valve needle 12 away from the sealing seat of the injection aperture 14. This causes the injection aperture 14 to open and the fuel to be discharged from the fuel chamber 13 via the injection aperture 14. Typically, an idle stroke section is provided between the control stud 16 and the closing element 8 when the actuator element 2 is not activated. The purpose of the idle stroke section is to absorb thermal expansions between housing and actuator element without the control stud 16 being activated.

The compensating element 6 is connected to the housing 1 by its end facing away from the actuator element 2 via a clamping screw 32. The compensating element 6 is fixed to the actuator element by its other end. The actuator element 2 abuts the base plate and one end of the compensating element 6.

The thermal expansion of compensating element 6 and actuator element 2 is equal to the thermal expansions of the compensating element 6 and the actuator element 2. Since piezo actuators typically comprise ceramic materials, their thermal expansion is generally low. Conversely, the housing 1 is typically made of a metallic material which has a far higher coefficient of thermal expansion. As the temperature of the injection module rises, the length of the interior therefore increases in the housing in which the actuator element 2 is situated and an idle stroke is formed which makes it necessary for a higher control voltage to be used in order to activate the actuator element 2 or for a larger actuator element 2 to be provided in order to produce the longer actuating path. The compensating element 6 is provided in order to avoid this, said compensating element having a higher coefficient of thermal expansion than the actuator element 2 in order to avoid the idle stroke being produced as a result of thermal expansion. Consequently the compensating element 6 preferably has a higher coefficient of thermal expansion than the coefficient of thermal expansion of the housing 1 in order to compensate the lower coefficient of thermal expansion of the actuator element 2. A compensating element 6 whose coefficient of thermal expansion is lower than the coefficient of thermal expansion of the housing 1 should of course be provided if the coefficient of thermal expansion of the actuator element 2 is greater than the coefficient of thermal expansion of the housing 1.

The coefficients of thermal expansion are matched to the lengths of the actuator element 2 and the compensating element 6 in such a way that in the event of uniform heating the housing and the common thermal expansion of compensating element 6 and actuator element 2 are identical. This is produced according to the following formula:

$$\alpha_{Actuator} \cdot L_{Actuator} + \alpha_{Compensating\text{-}element} \cdot L_{Compensating\text{-}element} = \alpha_{Housing} \cdot (L_{Actuator\text{-}element} + L_{Compensating\text{-}element})$$

where $\alpha_{Housing}$ corresponds to the coefficient of thermal expansion of the material of the housing 1, $\alpha_{Compensating\text{-}element}$ corresponds to the coefficient of thermal expansion of the material of the compensating element 6, $\alpha_{Actuator\text{-}element}$ corresponds to the coefficient of thermal expansion of the actuator element 2, $L_{Actuator\text{-}element}$ corresponds to the length of the actuator element 2, and $L_{Compensating\text{-}element}$ corresponds to the length of the compensating element 6.

The injection module heats up from the outside to the inside rather than uniformly, more particularly in the starting phase of the engine. This gives rise to thermal stresses which are caused by different changes in length of the elements as a result of different coefficients of expansion. These stresses cannot be avoided entirely. In order to reduce this, however, and thereby reduce the mechanical stress on the overall system, a thermally conducting element 33 is provided. The thermally conducting element 33 is embodied in the form of a sleeve which encloses the compensating element 6.

Figure 2:
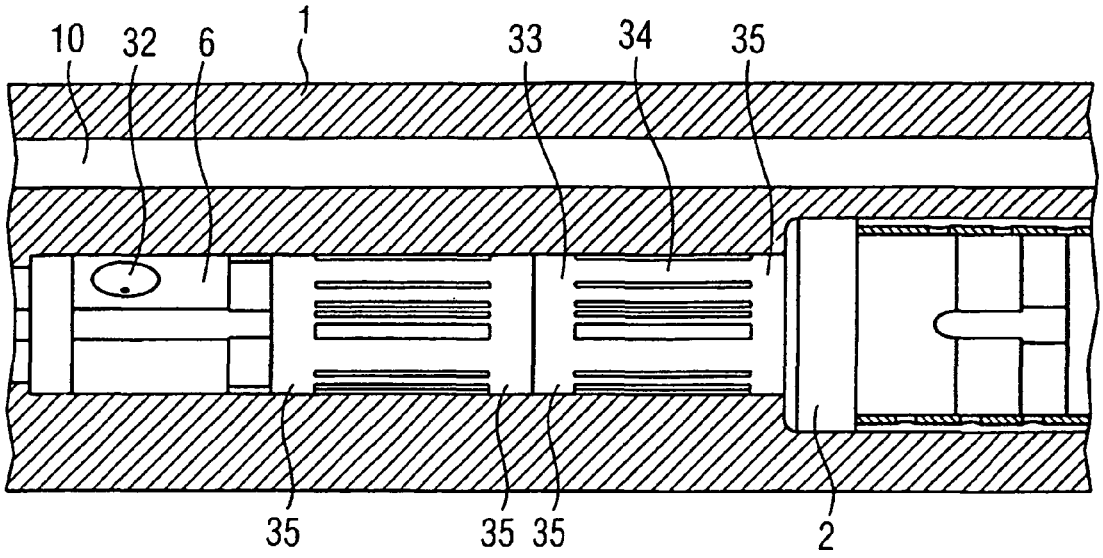
FIG. 2 shows an enlarged representation of the compensating element according to a preferred embodiment of the invention.

FIG. 2 shows the compensating element 6 and the thermally conducting element 33 in an enlarged view. The thermally conducting element 33 embodied as a sleeve 33 has slits as a result of which ridges are formed. These ridges are preferably curved outward and abut an internal wall of the housing 1 under a certain pretension. The sleeve 33 is preferably embodied as a metallic part and exhibits a particularly good thermal conductivity. The sleeve 33 can contain the materials copper, brass, silver and other materials which have particularly good heat conducting properties.

As a result of the fact that the ridges of the sleeve 33 are bent outward, they form a contact for the purpose of heat transfer with the housing 1. The edge areas of the sleeve 33 cause the sleeve 33 to abut the compensating element 6. A continuous conduction of heat is thus provided between the housing 1 and the compensating element 6.

It can of course be provided that the ridges 34 of the thermally conducting element 33 are bent inward, with the edge parts 35 of the sleeve 33 abutting the internal wall of the housing 1 and the inward-curved ridges 34 coming into contact with the compensating element. The essential point is that the thermally conducting element does not impede or prevent the movement of the compensating element 6 due to thermal expansion. Toward that end the thermally conducting element 33 must permit a slipping movement between the compensating element 6 and the thermally conducting element 33 or, as the case may be, between the thermally conducting element 33 and the internal wall of the housing 1.

A plurality of thermally conducting elements 33 can also be provided in order to improve the conduction of heat between the housing 1 and the compensating element 6. This increases the contact area between the internal wall of the housing 1 and the sleeve 33 or, as the case may be, between the sleeve and the compensating element 6, thereby speeding up the temperature compensation. In this way the thermal stresses which can be produced as a result of different temperatures of housing 1, actuator element 2 and compensating element 6 are reduced.

It can further be provided that the thermally conducting element 33 is embodied as a tensioned element which is in contact with the compensating element and the internal wall of the housing 1 under a mechanical tension. Such elements can be curved laminae, for example.

Figure 3:
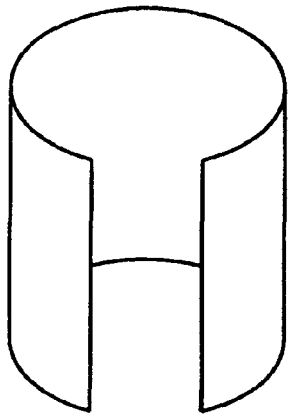
FIG. 3 shows a possible embodiment of a thermally conducting element.

A further embodiment of a sleeve is shown in FIG. 3. The sleeve 33 is split down its entire length and is preferably manufactured from a flexible material. This enables the sleeve 33 to make a better fit with the internal wall of the housing 1 and/or the compensating element 6.

The important point for the thermally conducting element 33 is that it provides an improved conduction of heat between housing 1 and compensating element 6.

We claim:

1. An injection module with a housing comprising:

an actuator element within the housing, wherein the actuator element changes its length when actuated according to an actuating stroke;

an injection valve within the housing, wherein the actuator element controls the injection valve by means of the actuating stroke;

a compensating element within the housing and arranged in series with the actuator element along an axial direction of the injection module, wherein a first end of the compensating element is connected to the actuator element and a second end of the compensating element is connected to the housing, wherein the compensating element compensates for changes in length of the housing as a result of thermal expansion; and a thermally conducting element disposed on the compensating element, wherein the thermally conducting element conducts thermal energy between the compensating element and the housing, and wherein the thermally conducting element allows slippage between the compensating element and the housing;

wherein the second end of the compensating element is connected to the housing at a retaining point in such a way that the thermal expansion of the housing between the retaining point and the injection valve is essentially equivalent to the sum of the thermal expansion of actuator element and the thermal expansion of the compensating element.

2. The injection module as claimed in claim 1, wherein the thermally conducting element is in contact with the housing and with the compensating element.

3. The injection module as claimed in claim 1, wherein the thermally conducting element is embodied as a sleeve which is disposed around the compensating element.

4. The injection module as claimed in claim 3, wherein the sleeve has longitudinal slits, with the ridges formed by the longitudinal slits being curved.

5. The injection module as claimed in claim 3, wherein the sleeve is a metal sleeve, preferably made of a material exhibiting good thermal conductivity, said material being in particular copper, brass or silver.

6. The injection module as claimed in claim 3, wherein the sleeve is split down its entire length.

7. An injection module as claimed in claim 1, wherein the second end of the compensating element is connected to the housing at a retaining point via a clamping screw.

8. An injection module with a housing comprising:

an actuator element within the housing, wherein the actuator element changes its length when actuated according to an actuating stroke;

an injection valve within the housing, wherein the actuator element controls the injection valve by means of the actuating stroke;

a compensating element within the housing and arranged in series with the actuator element along an axial direction of the injection module, wherein a first end of the compensating element is connected to the actuator element and a second end of the compensating element is connected to the housing, wherein the compensating element compensates for changes in length of the housing as a result of thermal expansion; and a plurality of thermally conducting elements disposed on the compensating element such that the thermal conducting elements are disposed in end-to-end fashion, wherein the plurality of thermally conducting elements conduct thermal energy between the compensating element and the housing, and wherein the plurality of thermally conducting elements allow slippage between the compensating element and the housing, wherein the second end of the compensating element is connected to the housing at a retaining point in such a way that the thermal expansion of the housing between the retaining point and the injection valve is essentially equivalent to the sum of the thermal expansion of actuator element and the thermal expansion of the compensating element.

9. The injection module as claimed in claim 8, wherein the plurality of thermally conducting elements is in contact with the housing and with the compensating element.

10. The injection module as claimed in claim 8, wherein the plurality of thermally conducting elements is embodied as a plurality of sleeves which are each disposed around the compensating element.

11. The injection module as claimed in claim 10, wherein each sleeve of the plurality of sleeves has longitudinal slits, with the ridges formed by the longitudinal slits being curved.

12. The injection module as claimed in claim 10, wherein each sleeve of the plurality of sleeves is a metal sleeve, preferably made of a material exhibiting good thermal conductivity, said material being in particular copper, brass or silver.

13. The injection module as claimed in claim 10, wherein each sleeve of the plurality of sleeves is split down its entire length.

14. An injection module as claimed in claim 8, wherein the second end of the compensating element is connected to the housing at a retaining point via a clamping screw.

* * * * *